US006319606B1

(12) United States Patent
Best

(10) Patent No.: US 6,319,606 B1
(45) Date of Patent: Nov. 20, 2001

(54) MONOFILAMENT, AND PAPERMAKING FABRIC MANUFACTURED THEREWITH

(75) Inventor: Walter Best, Duren (DE)

(73) Assignee: Thomas Josef Heimbach Gesellschaft mit beschrankter Haftung & Co. (DE)

( * ) Notice: Subject to any disclaimer, the term of this patent is extended or adjusted under 35 U.S.C. 154(b) by 0 days.

(21) Appl. No.: 09/334,071

(22) Filed: Jun. 16, 1999

(30) Foreign Application Priority Data

Jun. 18, 1998 (EP) ..... 98111207

(51) Int. Cl.[7] ..... B32B 27/34; D02G 3/00
(52) U.S. Cl. ..... 428/395; 428/364; 428/365
(58) Field of Search ..... 442/199; 428/364, 428/365, 395; 16/900, 902; 525/50

(56) References Cited

U.S. PATENT DOCUMENTS

| | | | | |
|---|---|---|---|---|
| 4,911,683 | * | 3/1990 | Legge et al. | 474/255 |
| 5,137,601 | | 8/1992 | Hsu | 162/358.2 |
| 5,731,059 | * | 3/1998 | Smith et al. | 428/192 |
| 5,763,040 | * | 6/1998 | Muphy et al. | 428/96 |
| 5,776,313 | * | 7/1998 | Bakis et al. | 162/358.2 |
| 5,958,322 | * | 9/1999 | Thompson et al. | 264/342 |
| 6,033,777 | * | 3/2000 | Best | 428/364 |
| 6,060,145 | * | 5/2000 | Smith et al. | 428/95 |
| 6,096,421 | * | 8/2000 | Waggoner et al. | 428/364 |
| 6,197,709 | * | 3/2001 | Tsai et al. | 442/347 |

FOREIGN PATENT DOCUMENTS

| | | |
|---|---|---|
| 4410399 | 9/1995 | (DE) . |
| 0070708 | 1/1983 | (EP) . |
| 0372769 | 6/1990 | (EP) . |
| 0520162 | 12/1993 | (EP) . |
| 0844320 | 5/1998 | (EP) . |
| 4418931 | 8/1969 | (JP) . |
| 4823966 | 7/1973 | (JP) . |
| 5460351 | 5/1979 | (JP) . |
| 6052616 | 3/1985 | (JP) . |
| 7278946 | 10/1995 | (JP) . |
| 170660 | 3/1999 | (JP) . |

OTHER PUBLICATIONS

Publication AN 96–283978.

* cited by examiner

*Primary Examiner*—Terrel Morris
*Assistant Examiner*—Christopher C. Pratt
(74) *Attorney, Agent, or Firm*—Liniak, Berenato, Longacre & White, LLP

(57) ABSTRACT

The invention concerns a monofilament for use in engineering textiles, in particular in papermaking fabrics, made up of a plastic material having a principal constituent that is polytrimethylene terephthalate (PTMT) and at least one additional constituent, and is characterized in that the additional constituent is a nylon or a mixture of several nylon types. The invention further concerns a papermaking fabric having the aforesaid monofilaments.

20 Claims, No Drawings

MONOFILAMENT, AND PAPERMAKING FABRIC MANUFACTURED THEREWITH

The invention concerns a monofilament for use in engineering textiles, in particular in papermaking fabrics, made up of a plastic material having a principal constituent that is polytrimethylene terephthalate (PTMT) and at least one additional constituent.

For technical textiles, monofilaments are used in many cases as yarns from which woven or knitted textiles, yarn plies, etc. are manufactured. Either the technical textile comprises such woven or knitted textiles or yarn plies, or the latter form a base for coatings, needle-felted fiber batts, or the like. Particular technical textiles are endless belts—with or without a seam—that travels around in machines. These include papermaking fabrics, which are used to form and transport the paper web through the individual parts if of the papermaking machine, i.e. the forming area and the pressing and drying sections. The papermaking machine cloths are configured differently for the individual parts of the papermaking machine.

A variety of plastic materials have been proposed in the past. Polyester or nylon types, in the latter case predominantly nylon-6 types, have been used for some time in papermaking fabrics (cf. DE-A-44 10 399). More recently it has also been proposed to use nylon-11 or nylon-12 types (cf. JP Published Application 60-52616) both for the base fabric and for the fibers of the needle-felted fiber layers (cf. EP-A-0 070 708, EP-A-0 372 769). It has also been previously proposed to manufacture monofilaments from a core made up, for example, of nylon-6/6 or polyethylene terephthalate, and a sheath of nylon-11 or nylon-12 (cf. EP-A-070 708).

To improve resistance to the chlorine-containing substances that occur in papermaking machines, papermaking fabrics have been designed in which the fibers of the base fabric are made of polybutylene terephthalate, and the needle-felted fiber batt is made of polyethylene terephthalate. Since the mechanical properties of the latter material are poorer than those of nylon, the use of polytrimethylene terephthalate (PTMT), also called polypropylene terephthalate, has been proposed (cf. U.S. Pat. No. 5,137,601), both for the monofilaments of the base fabric and for the fibers of an optional fiber batt covering. This material is said to have the same chemical resistance as polybutylene terephthalate and polyethylene terephthalate, but additionally to have mechanical properties similar to nylon-6, especially with regard to elasticity and abrasion resistance. In terms of temperature resistance, this material is said to be better than nylon-6.

An effort has also been made to combine the good properties of polyester, in particular of polyethylene terephthalate, with considerably improved abrasion behavior (cf. DE-A-44 10 399). It is has been proposed for this purpose to mix a thermoplastic polyurethane into the polyester.

A further development based on polytrimethylene terephthalate is evident from EP-A0 844 320. The latter discloses a monofilament that contains, only in part although also as the principal constituent, polytimethylene terephthalate that is mixed with polyurethane, in particular elastomeric polyurethane, in order to enhance abrasion resistance. It has been found, however, that considerable problems arise in the processing of monofilaments made of PTMT material to produce woven or knitted textiles: inhomogeneity and warping occur. It has been determined that the reason for this is the high elasticity of the PTMT monofilaments, although this elasticity behavior is described in U.S. Pat. No. 5,137,601 as being favorable for manufacturability. The elasticity behavior is also not changed by the admixture of polyurethane proposed in EP-A-0 844 320.

It is thus the object of the invention to discover a plastic material that on the one hand has the favorable chemical and mechanical properties of PTMT, but on the other hand can be processed much better into woven or knitted textiles and thus permits the manufacture of uniform and nonwarping textile webs.

This object is achieved by a monofilament made of a plastic material having a principal constituent that is PTMT, in which, according to the present invention, the additional constituent is a nylon or a mixture of several nylon types. It has been found that a monofilament made of such a plastic material can be processed much better into woven or knitted textiles or the like, for example for papermaking fabrics. The reason for this is the fact that the elasticity of the monofilament is considerably reduced by the admixture of nylon. It has been found in this context, surprisingly in view of U.S. Pat. No. 5,137,601, that chemical resistance, in particular to chlorine-containing substances, is not appreciably impaired by the nylon admixture. Even more surprising is the fact that a gain in strength can be achieved that is more than the strength values of the individual components (PTMT on the one hand, and nylon on the other hand). This creates the possibility of manufacturing engineering textiles of equal tensile strength using monofilaments of smaller cross section, and thereby saving weight and cost.

Essentially all nylon types are possible as the additional constituent, i.e. including the nylon-6 types, even though they have a relatively high water uptake. Since the water uptake of PTMT is very low, the higher water uptake capability of nylon-6 types has substantially no effect. Even better properties can be achieved, however, by the admixture of nylon-11 and/or nylon-12, since these nylon types are characterized by low water uptake and even better abrasion resistance and chemical resistance. Several different nylon types can also be added to the PTMT.

The concentration of the nylon additional constituent can be adjusted so as to achieve, as a function of the particular nylon type used, the optimum properties profile for the particular application. The concentration can range up to 50%. The processability and also the strength of the monofilament are, however, already considerably improved if the nylon concentration is 5%. A particularly favorable properties profile results with concentrations of between 10 and 35%.

The mixture according to the present invention is homogeneous in the sense that it is not limited to solution-like distributions. The mixture can also be manufactured from a uniform mixture of the powdered constituents or of pellets.

It is understood that further additional constituents can also be present, for example a hydrolysis stabilizer and/or an antioxidant; the concentrations in each case can range up to 5%.

The monofilament according to the present invention can have any desired cross-sectional shape, for example rectangular, cloverleaf-shaped, dog-bone-shaped, star-shaped, round, oval, or the like. A configuration as a hollow filament is also possible. The cross-sectional area of the monofilament should preferably be between 0.02 and 3.5 $mm^2$, which corresponds in the case of a round cross section to a diameter of 0.08 to 1 mm.

To the extent the monofilament according to the present invention is used for the manufacture of a support for a papermaking fabric, there additionally exists the possibility of applying, on one or both sides, a fiber layer whose fibers have polytrimethylene terephthalate at least partially as the principal constituent. Here again, nylon or a mixture of several nylons is possible as the additional constituent. Advantageously, the composition of the plastic material for the fibers corresponds to that for the monofilaments.

Papermaking fabrics designed in this fashion can be used fundamentally in all parts of the papermaking machine. If they are configured as a felt, they are suitable in particular as the upper or lower felt in a shoe press. Despite its nylon content, the papermaking fabric is characterized by good temperature resistance, so it can be used even in places where the working temperature exceeds 55°.

What is claimed is:

1. A papermaking fabric having monofilaments, said monofilaments being made of a plastic material comprising polytrimethylene terethhthalate (PTMT) as a principal constituet and at least one additional constituent comprising nylon.

2. The papermaking fabric as defined in claim 1, wherein said additional constituent is selected from the group consisting of nylon-11, nylon 12, and mixtures thereof.

3. The papermaking fabric as defined in claim 1, wherein said additional constituent is present in said plastic material in a concentration of up to 45 wt %.

4. The papermaking fabric as defined in claim 1, wherein said additional constituent is present in said plastic material in a concentration of at least 5 wt %.

5. The papermaking fabric as defined in claim 1, wherein said plastic material includes a hydrolysis stabilizer.

6. The papermaking fabric as defined in claim 1, wherein said hydrolysis stabilizer is present in said plastic material in a concentration of up to 5 wt %.

7. The papermaking fabric as defined in claim 1, wherein said plastic material contains an antioxidant.

8. The papermaking fabric as defined in claim 1, wherein a cross-sectional area of said monofilament is 0.2 to 3.5 $mm^2$.

9. The papermaking fabric as defined in claim 1, wherein said monofilament has a round cross section with a diameter of between 0.08 and 1 mm.

10. The papermaking fabric as defined in claim 1, wherein said monofilament has a square, rectangular, oval, cloverleaf-shaped, or dog-bone-shaped cross section.

11. The papermaking fabric as defined in claim 1, further comprising:

a fiber layer whose fibers have polytrimethyleneterephthalate at least partially as a principal constituent, said fiber layer being present on one or both side of the papermaking fabric.

12. The papermaking fabric as defined in claim 11, wherein the fibers having polytrimethylene terephthalate as the principal constituent have a nylon or a mixture of several nylon types as an additional constituent.

13. The papermaking fabric as defined in claim 11, wherein said plastic material for the monofilaments and said fibers have identical compositions.

14. The papermaking fabric as defined in claim 1, wherein said additional constituent is present in said plastic material in a concentration of from about 5 wt % to about 45 wt %.

15. The papermaking fabric as defined in claim 1, wherein said additional constituent is present in said plastic material in a concentration of from about 10 wt % to about 35 wt %.

16. The papermaking fabric as defined in claim 1, wherein said additional constituent is a nylon selected from the group consisting of nylon-6, nylon-11 and nylon-12.

17. The papermaking fabric as defined in claim 1, wherein said additional constituent is a mixture of nylon-11 and nylon-12.

18. The papermaking fabric as defined in claim 1, wherein said plastic material is formed from a solution of PTMT and said additional constituent.

19. The papermaking fabric as defined in claim 1, wherein said plastic material is formed from a mixture of particles of PTMT and said additional constituent.

20. A papermaking fabric having monofilaments comprising a mixture of polytrimethyleneterephthalate (PTMT) and an additional constituent comprising nylon, wherein a concentration of said PTMT in said mixture is higher than a concentration of said additional constituent in said mixture.

* * * * *